US010413773B2

(12) United States Patent
Price

(10) Patent No.: US 10,413,773 B2
(45) Date of Patent: Sep. 17, 2019

(54) WORKOUT MACHINE

(71) Applicant: Abigail Price, Reno, NV (US)

(72) Inventor: Abigail Price, Reno, NV (US)

( * ) Notice: Subject to any disclaimer, the term of this patent is extended or adjusted under 35 U.S.C. 154(b) by 163 days.

(21) Appl. No.: 15/681,805

(22) Filed: Aug. 21, 2017

(65) Prior Publication Data

US 2019/0054339 A1 Feb. 21, 2019

(51) Int. Cl.

| | |
|---|---|
| ***A63B 21/06*** | (2006.01) |
| ***A63B 21/068*** | (2006.01) |
| ***A63B 24/00*** | (2006.01) |
| ***A63B 21/00*** | (2006.01) |
| ***A63B 23/035*** | (2006.01) |
| ***A63B 23/12*** | (2006.01) |
| ***A63B 21/055*** | (2006.01) |
| ***A63B 71/06*** | (2006.01) |

(52) U.S. Cl.

CPC ..... *A63B 21/0616* (2015.10); *A63B 21/068* (2013.01); *A63B 21/153* (2013.01); *A63B 21/154* (2013.01); *A63B 21/4043* (2015.10); *A63B 23/03525* (2013.01); *A63B 23/1209* (2013.01); *A63B 24/0062* (2013.01); *A63B 21/055* (2013.01); *A63B 21/155* (2013.01); *A63B 2071/065* (2013.01); *A63B 2210/50* (2013.01); *A63B 2220/17* (2013.01); *A63B 2220/40* (2013.01); *A63B 2225/20* (2013.01); *A63B 2225/685* (2013.01)

(58) Field of Classification Search

CPC ..... A63B 21/06; A63B 24/00; A63B 21/15; A63B 21/05

See application file for complete search history.

(56) References Cited

U.S. PATENT DOCUMENTS

| | | | | | |
|---|---|---|---|---|---|
| 3,832,746 | A | | 9/1974 | Ogletree | |
| 4,077,626 | A | | 3/1978 | Newman | |
| 4,135,714 | A | * | 1/1979 | Hughes | A63B 21/04 473/229 |
| 4,231,568 | A | * | 11/1980 | Riley | A63B 21/04 482/130 |
| 4,257,592 | A | | 3/1981 | Jones | |
| 4,497,457 | A | | 2/1985 | Harvey | |
| 4,511,137 | A | * | 4/1985 | Jones | A63B 21/00181 482/100 |
| 4,944,511 | A | | 7/1990 | Francis | |
| 5,072,929 | A | * | 12/1991 | Peterson | A63B 22/0076 310/105 |
| 5,108,090 | A | | 4/1992 | Reed | |

(Continued)

*Primary Examiner* — Garrett K Atkinson

(74) *Attorney, Agent, or Firm* — Timothy Engling

(57) ABSTRACT

A workout machine adapted to be used with a smart device with built-in accelerometers and an app. It has a deck movable relative to its base and a lifting gear assembly operationally using a cable via a pulley to a lifting handle. A user location pivot arm is fixed to the deck, and a screen stand extends from the deck, where the user location pivot arm and screen stand are pivotably attached to a screen platform that can hold the smart device during a workout. The user's position on the deck can indicate the resistance of the exercise based on a percentage of the user's own weight as lifted with each repetition. The fulcrum concept combined with a user location feature allow an app of the smart device to support and analyze a workout.

5 Claims, 3 Drawing Sheets

(56) References Cited

U.S. PATENT DOCUMENTS 5,234,392 A * 8/1993 Clark ..... A63B 69/0035 482/112
5,352,172 A 10/1994 Suzaki
5,556,369 A 9/1996 Roberts
5,569,130 A * 10/1996 Wang ..... A63B 22/0076 482/51
5,626,541 A 5/1997 Ramlogan et al.
5,645,514 A 7/1997 Chen
5,702,328 A * 12/1997 Mansvelt ..... A63B 21/068 482/96
5,800,321 A 9/1998 Webber
6,004,248 A * 12/1999 Price ..... A63B 21/055 482/121
6,224,514 B1 * 5/2001 Price ..... A63B 21/055 242/470
6,234,934 B1 5/2001 Gorczyca
6,283,899 B1 * 9/2001 Charnitski ..... A63B 21/15 482/102
6,315,701 B1 11/2001 Shifferaw
6,409,637 B1 6/2002 Webber et al.
6,749,546 B2 6/2004 Yang
7,169,097 B1 * 1/2007 Stearns ..... A63B 21/068 482/140
7,250,021 B2 7/2007 Leight
7,250,022 B2 7/2007 Dalebout et al.
7,270,291 B2 9/2007 Von Seidel
7,364,538 B2 * 4/2008 Aucamp ..... A63B 21/154 482/131
7,591,763 B1 9/2009 Fucci
7,666,126 B2 * 2/2010 Rempe ..... A63B 22/18 482/121
7,806,812 B2 10/2010 Humble et al.
7,922,635 B2 * 4/2011 Lull ..... A63B 21/00 482/100
7,938,760 B1 * 5/2011 Webber ..... A63B 21/0615 482/97
7,955,231 B1 * 6/2011 Chen ..... A63B 21/068 482/142
7,981,010 B1 * 7/2011 Webber ..... A63B 21/0615 482/100
8,162,807 B1 * 4/2012 Webber ..... A63B 21/0615 482/100
9,080,647 B2 * 7/2015 Lee ..... E05F 11/483
9,358,413 B2 * 6/2016 Verdi ..... A63B 71/023
9,539,460 B2 * 1/2017 Ellis ..... A63B 21/0615
9,700,751 B2 * 7/2017 Verdi ..... A63B 21/4019
9,770,622 B2 * 9/2017 Campanaro ..... A63B 22/0087
10,010,747 B2 * 7/2018 Campanaro ..... A63B 22/0087
10,220,247 B2 * 3/2019 Ellis ..... A63B 21/225
2002/0077230 A1 * 6/2002 Lull ..... A63B 21/00 482/142
2002/0137599 A1 9/2002 Kuo
2004/0229737 A1 * 11/2004 Stearns ..... A63B 21/154 482/139
2005/0096196 A1 * 5/2005 Webber ..... A63B 21/4047 482/94
2006/0040810 A1 * 2/2006 Chu ..... A63B 21/068 482/142
2006/0135329 A1 * 6/2006 Owen ..... A63B 21/04 482/123
2006/0183606 A1 * 8/2006 Parmater ..... A63B 22/0076 482/72
2009/0312165 A1 * 12/2009 Rempe ..... A63B 22/18 482/146
2011/0143888 A1 * 6/2011 Chen ..... A63B 21/068 482/96
2012/0035024 A1 2/2012 Price
2013/0303334 A1 * 11/2013 Adhami ..... A63B 21/025 482/4
2013/0324374 A1 * 12/2013 Ellis ..... A63B 21/0615 482/97
2014/0194260 A1 * 7/2014 Campanaro ..... A63B 21/068 482/131
2015/0051056 A1 * 2/2015 Scheffer ..... A63B 69/0028 482/124
2016/0107023 A1 * 4/2016 Campanaro ..... A63B 22/0087 482/72
2016/0287922 A1 * 10/2016 Baudhuin ..... A63B 21/4017
2017/0157450 A1 * 6/2017 Anderson ..... A63B 21/16
2018/0001133 A1 * 1/2018 Campanaro ..... A63B 22/0087
2018/0169463 A1 * 6/2018 Ellis ..... A63B 21/225

* cited by examiner

WORKOUT MACHINE

FIELD OF THE DISCLOSURE

This disclosure relates to a workout machine for which it is easy to change the resistance for each set of exercises. More specifically, the disclosure relates to a workout machine with a physical machine adapted to function with a smart device having sensors and a complementary app.

BACKGROUND

A workout machine is preferably capable of enabling the user to perform various exercises without significant modification or rearrangement of components of the workout machine. Another goal of proper exercising is producing a smooth resistance in performing an exercise with easy-to-use equipment.

U.S. Pat. Nos. 6,004,248 and 6,224,514 disclose an exercise apparatus having a base to which is pivoted one end of a rockable arm, the opposite end of which is coupled to one end of a force transmitting line by means of which the arm may be rocked from and to a rest position. Movement of the arm away from the rest position is yieldably opposed by elastic resistance members that react between the rockable arm and the base. An upright arm is removably supported by the base and is equipped with one or more line guides about which the force transmitting line may be reeled. In one embodiment, the line guide automatically compensates for variations in the force applied on the rockable arm to overcome variations in the resistance of the resistance members.

In analyzing different options, a machine was desirable where it was easier to change the resistance for each set of exercises. A workout machine with less assembly required and avoiding a resistance band were considerations for an alternate workout machine. An alternative to the resistance bands was also considered. But the concept of a graduated spooling mechanism is adapted from U.S. Pat. No. 6,225,514, which is incorporated herein by reference. The grooves on the graduated spooling mechanism track along an increasing diameter spool. The distance around the first revolution is shorter than around the second revolution.

The present exercise machine incorporates components from earlier family inventions, such as the lifting handle. U.S. Patent Publication 2012 0035024 discloses a Portable Exercise Machine with a spooling, anchoring and centering handle that allows the length of the cable to be easily adjusted, centered for symmetrical lifting while being safely anchored. This handle allows a user to quickly adjust the length of cable on the machine to easily reconfigure the machine to perform various exercises.

The focus of this disclosure is a versatile, compact and easy-to-use workout machine that allows performing multiple exercises without extensive assembly or adjustment to the workout machine.

Certain prior art uses apps to assist with exercises, and tracking and storing data. Prior known exercise machines incorporate such apps into internal hardware. Prior known smart devices, such as iPhone® devices, tablets, and pads, have accelerometers that can sense and measure pitch, movement, and angles of the device (and thus its user in certain circumstances), and can supply that data to separate machines. An accelerometer is a device that detects its own acceleration and is commonly used in mobile phones to determine the phone's orientation. Once the orientation is determined, the phone's software can react accordingly, such as by changing its display from portrait to landscape, or otherwise providing such information. But no apps are known that interact with a workout machine that adjusts calculations based on the position of the user on the workout machine.

SUMMARY

The present disclosure provides a workout machine that includes a few conventional components, and is lightweight, compact and portable. The workout machine allows performing multiple exercises without extensive assembly or adjustment to the workout machine. Thus, it is simple to use and allows for a full body workout.

The disclosed workout machine makes it easy to change resistance for each set of exercises. One aspect has the user lifting her own weight to a certain amount with the percentage of her own body weight determining the level of resistance for each exercise. To change the resistance, the user may move her own body back and forth on a platform or deck to change the resistance for each set of exercises. In a preferred situation, the user does not need to leave the workout machine to adjust the resistance, but only adjust her position. The variable fulcrum concept allows the user to lift a different percentage of her own weight at different locations on the workout machine. When the user stands closer to a front of the deck, the user is effectively creating a longer lever relative to such fulcrum and resistance needed to lift the deck that the user is standing on is reduced, and as the user moves back on the deck, the user is effectively creating a shorter lever relative to the fulcrum and resistance is greater. No free weights need be added, and the cable can be quickly reset as needed.

The workout machine is relatively simple in its physical structure and can be used with the user's own smart technology to have preferred functionality without the expense of internal electronics.

In a preferred embodiment, a smart device, such as a phone, pad or tablet, can be used on a platform that moves as a component of the workout machine. The device's accelerometer can measure various movements, pitches, angles, etc. to determine relative location, track movements and number of lifts.

The workout machine as adapted to be used with a smart device with built-in accelerometers has a deck movable relative to its base. A lifting gear assembly operationally uses a cable via a pulley to a lifting handle. A user location pivot arm is fixed to the deck, and a screen stand extends from the deck, where the user location pivot arm and screen stand are pivotably attached to a screen platform adapted to hold the smart device. The user's position on the deck can indicate the resistance of the exercise based on a percentage of the user's own weight being lifted. The algorithmic aspect of the fulcrum concept combined with a user location feature allow an app of the smart device to calculate a percent of the user's body weight that the user is lifting with each repetition to measure the resistance used for each repetition.

The disclosed innovative, versatile, easy-to-use workout machine is affordable with minimal parts and cost-effective manufacturing options, such as plastic ejected molded parts, rather than steal or aluminum. While a workout machine can have internally integrated electronics, a preferred design incorporates apps and technology from existing smart devices, such as smart phones and pad devices, which can be combined with the workout machine. An interactive app can enhance the interactive/social aspect of the workout machine.

BRIEF DESCRIPTION OF THE DRAWINGS

The above-mentioned and other features of this disclosure and the manner of obtaining them will become more apparent, and the disclosure itself will be best understood by reference to the following descriptions of methods considered in conjunction with the accompanying figures, which are given as non-limiting examples only, in which.

The exemplifications set out herein illustrate an embodiment of the disclosure that is not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiments in different forms, the figures show, and herein described in detail, embodiments with the understanding that the present descriptions are to be considered exemplifications of the principles of the disclosure and are not intended to be exhaustive or to limit the disclosure to the details of construction and the arrangements of components and steps set forth in the following description or conveyed in the figures.

As disclosed, a lightweight, versatile, and compact workout machine 12 allows performing multiple exercises without extensive adjustment to the workout machine, such as moving heavy weights or reconfiguring the components. In fact, no adjustments to the workout machine 12 are needed to change resistance of exercises, and the change of position of the user allows an infinite number of resistance levels.

Figure 1:
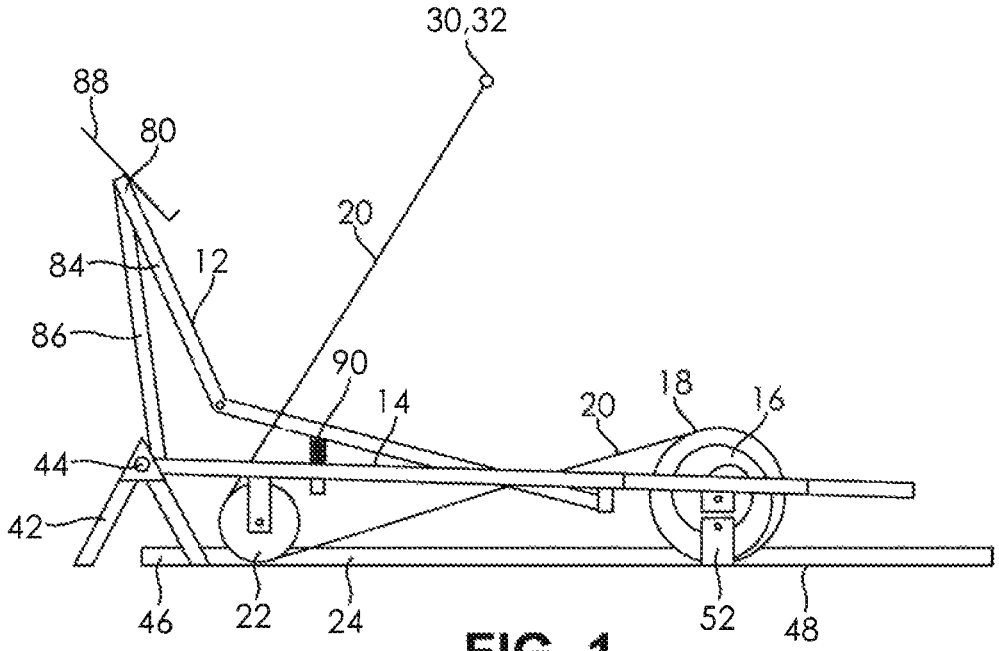
FIG. 1 shows a side view of a workout machine.
Figure 2:
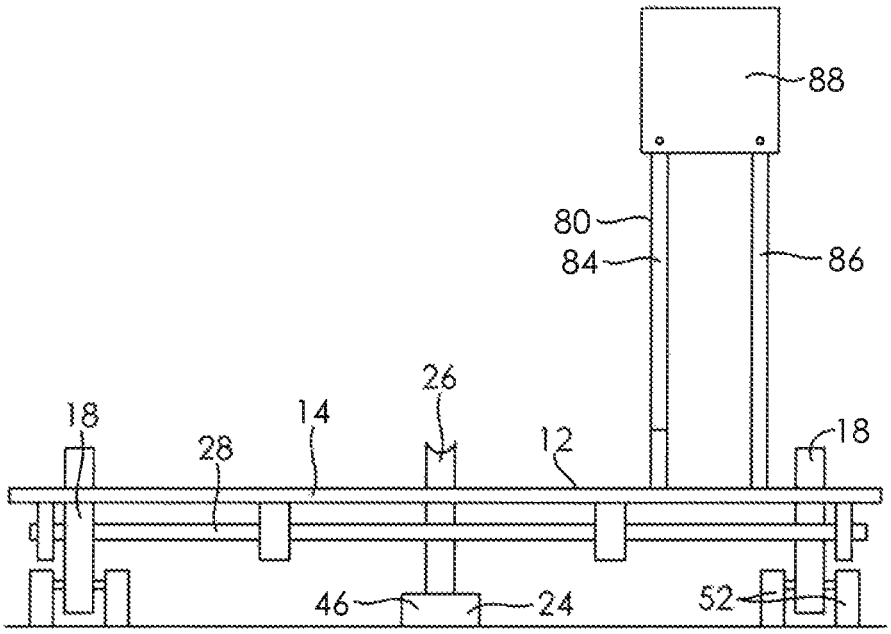
FIG. 2 shows a rear view of the workout machine.
Figure 6:
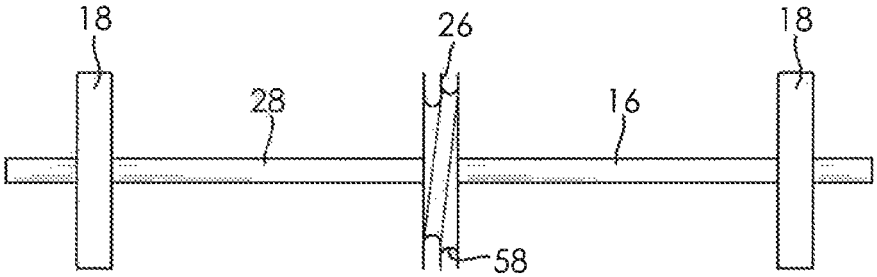
FIG. 6 shows a schematic end view of a preferred lifting gear assembly of the workout machine.

A workout machine 12 includes a deck 14 with a lifting gear assembly 16 mounted on the deck 14, preferably on the underside of the deck 14 as shown in FIGS. 1 and 2. The lifting gear assembly 16 preferably includes a spiral lifting mechanism 18 (one or more) and a graduated spooling mechanism 26 with a shaft 28 centered in those, wherein the lifting gear assembly 16 operates in conjunction with a cable 20 (as defined to be broad enough to include a rope, cord, line or even chain) via the graduated spooling mechanism 26 and a pulley 22 (toward the front) also preferably attached on the underside of the deck 14, located above a base 24 of the workout machine 12. As shown in FIGS. 2 and 6, the graduated spooling mechanism 26 and the two spiral lifting mechanisms 18 are mounted on a shaft 28 to form the preferred lifting gear assembly 16. The shaft 28 can span the width of the deck 14 (its rear section as shown) to provide support and stability across the workout machine 12. The lifting gear assembly 16 is preferably mounted to the bottom of the deck 14 with four pillow blocks or cushion fasteners. The graduated spooling mechanism 26 and the two spiral lifting mechanisms 18 as shown protrude through multiple channels in the back of the deck 14. As shown, the graduated spooling mechanism 26 mounts to the center of the shaft 28, and each spiral lifting mechanism 18 mounts to each end of the shaft 28. The front distal end of the cable 20 is attached to a lifting handle 30.

The graduated spooling mechanism 26 optimizes the circumference and number of revolutions during use to minimize the needed size in relation to the spiral lifting mechanism 18. The spiral grooves 58 on the graduated spooling mechanism 26 track along an increasing diameter spool. The distance around the first revolution is shorter than around the second revolution. This change in pitch can offset the mechanical advantage created by the changing circumference of the spiral lifting mechanism 18. As such, the pitch of the graduated spooling mechanism 26 is designed to offset the changes in resistance generated from the change in diameter in the corresponding spiral lifting mechanism 18 resulting in more uniform resistance throughout any particular lift. The diameter of the preferred graduated spooling mechanism 26 has been optimized to allow over thirty-two inches of travel (needed to accommodate the reach of a 6'2" user) with only two revolutions. The two revolutions correspond with the two revolutions that the engineering of the spiral lifting mechanisms 18 allow.

The lifting handle 30 is preferably a spooling, and anchoring and centering handle 32 as shown in FIG. 8 of U.S. Patent Publication 2012 0035024, which is incorporated herein by reference. The spooling, anchoring and centering handle 32 allows the length of the cable 20 to be easily adjusted, centered for symmetrical lifting while being safely anchored. The lifting handle 30 allows a user to quickly adjust the length of cable 20 on the workout machine 12 to easily modify the workout machine 12 to perform various exercises. As an example, the lifting handle 30 may be constructed of 26-inch-long one-inch OD tubing, with eight-inch wide, ¼ inch thick foam padding at end of each tube and plastic end caps on the tubing. A center cable/rope spooling and tie off assembly can be injection molded, centered on lifting handle 30 as per the spooling, and anchoring and centering handle 32.

The cable 20 attaches to the lifting handle 30 (preferably the center as per spooling, and anchoring and centering handle 32), goes through a channel 34 in the deck 14 (as shown the front center), partially wraps around the pulley 22, preferably attached to the underside of the deck 14, and is pre-wound around the preferred graduated spooling mechanism 26 at the back of the workout machine 12.

Figure 5:
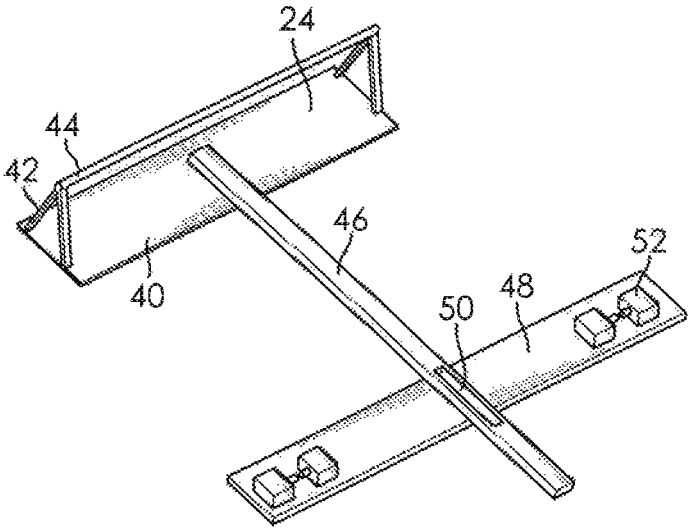
FIG. 5 shows a perspective view of a base of the workout machine.

The base 24 of the workout machine 12 supports the deck 14. The deck 14 hinges and pivots up and down relative to the base 24. As shown in FIG. 5, the base 24 may include a front bottom plate 40, one or more front upright support 42 (preferably left and right), and a round hinge tubing 44, which may extend across the front upright supports 42. The round hinge tubing 44 acts as a hinge mounted on the front, which allows the deck 14 to attach and pivot up and down relative to the base 24 (or bottom platform in this configuration).

As an example, the round hinge tubing 44 can be centered on the front bottom plate 40 allowing the front bottom plate 40 to extend past the deck 14 to prevent workout machine 12 from tipping forward while in use. A center support beam 46 of the base 24 may extend past the rear of the deck 14 to prevent tipping backwards. The center support beam 46 links front bottom plate 40 and rear bottom plate 48. Ideally, a channel 50 is formed on the center support beam 46 and/or rear bottom plate 48 to accommodate the graduated spooling mechanism 26 allowing the deck 14 to sit lower to the ground. The base 24 connects to pivot points and allows movement, such as lifting of the deck 14.

The base 24 provides connection points for one or more cam follower 52 to engage with each spiral lifting mechanism 18 (as shown with two spiral lifting gears). As an example, the cam follower 52 can be mounted to each side of the rear bottom plate 48, and each cam follower 52 can extend into the respective spiral lifting mechanism 18, including the logarithmic spiral grooves 56. In a resting position, the cam followers 52 extend into the logarithmic spiral grooves 56 near the center of each spiral lifting mechanism 18.

The cable 20 is pre-wound around the graduated spooling mechanism 26, which preferably has spiral grooves 58 that trace a cone shape. The graduation of the spool adjusts for the changes in diameter of the logarithmic spiral grooves 56 in the spiral lifting mechanism 18. The graduated spooling mechanism 26 optimizes the circumference and number of revolutions during use to minimize the needed size in relation to the spiral lifting mechanism 18. The cable 20 extends toward and rotates around the pulley 22 mounted toward the front of the deck 14, exits the channel 34 in the front of the deck 14, and attaches to the lifting handle 30.

In using the workout machine 12, as the user pulls on the lifting handle 30, the cable 20 unwinds and turns the lifting gear assembly 16. As the lifting gear assembly 16 turns, the cam followers 52 that are in a fixed position on the rear bottom plate 48 follow the logarithmic spiral grooves 56 of the of the spiral lifting mechanism 18 starting near the center 60 of the spiral lifting mechanism 18 at a cam follower starting point 62 and trace the logarithmic spiral groove 56, which end at the cam follower ending point 64 near the outside of the spiral lifting mechanism 18.

Because the rear bottom plate 48 is fixed, and the deck 14 pivots in conjunction with the rear bottom plate 48, the deck 14 raises the equal distance between the center most groove point 62 of the spiral lifting mechanism 18 to the outer most groove point 64 of the spiral lifting mechanism 18 resulting in the user lifting a percentage of her own bodyweight.

Figure 7:
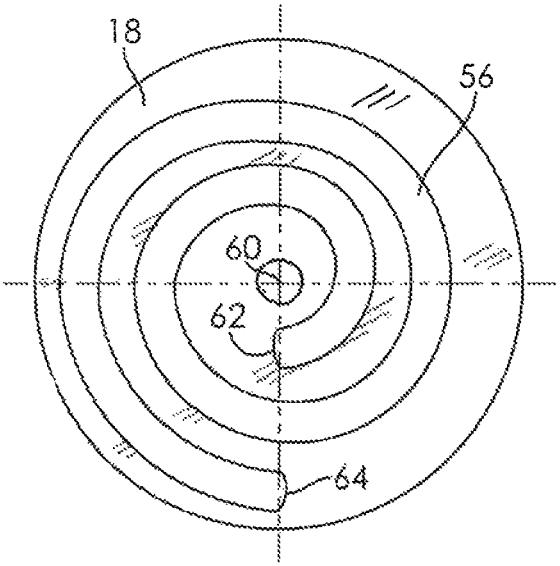
FIG. 7 shows a side view of a preferred spiral lifting mechanism of the workout machine.

In the preferred spiral lifting mechanism 18 as shown in FIG. 7, each spiral lifting gear utilizes the mathematics of a logarithmic spiral to lift the user/platform of the workout machine 12 at a constant rate. The workout machine 12 preferably uses two spiral lifting gears of FIG. 6 as the spiral lifting mechanism 18 to provide stability at the rear of the workout machine 12. The unique engagement of the spiral lifting gears fixed to the deck 14 and the cam followers 52 fixed to the base 24 result in an upward force during use to create resistance for the user.

The spiral lifting mechanism 18 may include two aluminum or injected molded plastic disks, one attached to each end of the lifting gear. A logarithmic spiral groove 56 is preferably molded or milled into one or both sides of each disk. The spiral lifting mechanism 18 uses the geometry of the logarithmic spiral to provide a constant pitch or slope of the spiral resulting in continuous resistance throughout any exercise performed. For structural stability, the logarithmic spiral grooves 56 are approximately ⅓ the depth of each disk. With a logarithmic groove on each side of one disk, ⅓ of the material remains a part of the disk for vertical strength between the depths of each logarithmic spiral groove 56.

The base 24 remains stable on the floor. A preferred center support beam 46 of the base 24 is designed for stability and to minimize material and weight. The channel 50 allows the lifting gear assembly 16 to sit lower, creating a lower profile for overall workout machine 12. The center support beam 46 of the base 24 preferably extends past the rear of the deck 14 to prevent backward tipping during use. The base 24 preferably also extends past the front of the deck 14 to prevent forward tipping during use. The integration of the deck 14 with the base 24 ideally supports all four corners of the workout machine 12 for maximum stability.

Figure 3:
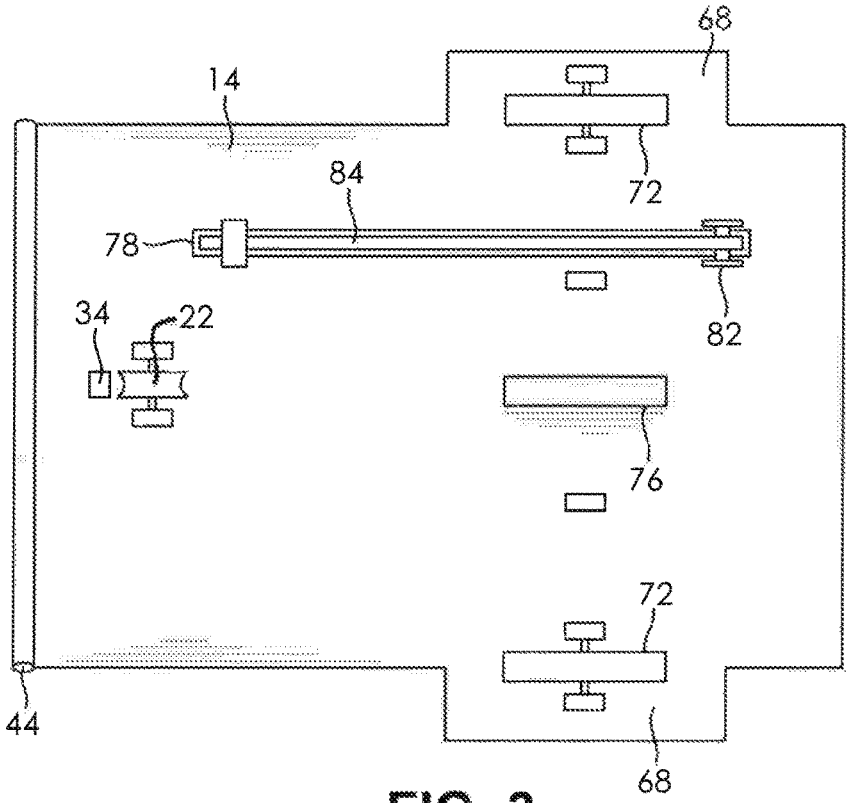
FIG. 3 shows a bottom view of a deck of the workout machine.
Figure 4:
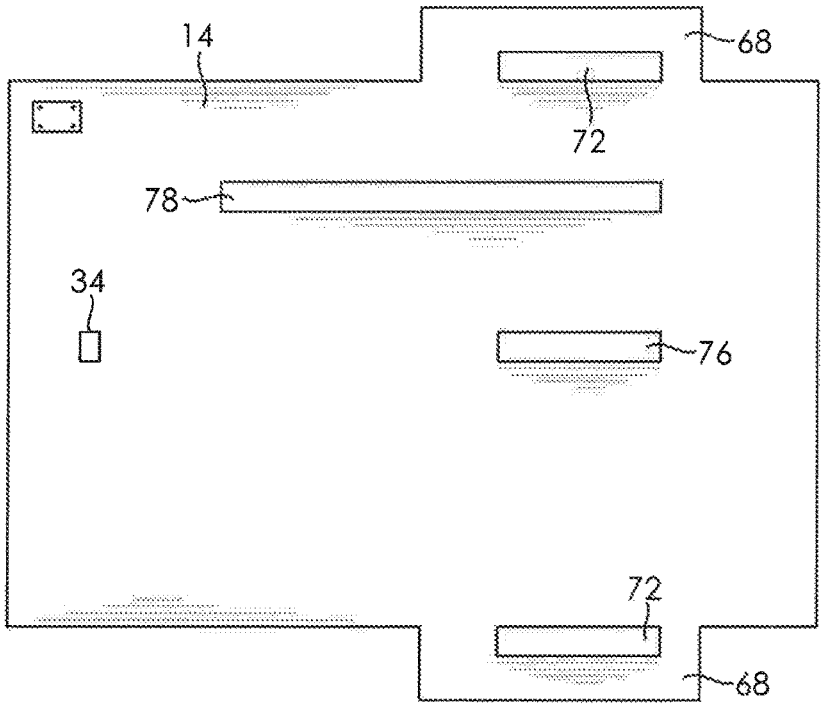
FIG. 4 shows a top view of the deck of the workout machine.

The preferred deck 14 may include side extensions 68 on each side to free up room for the user. As shown in FIGS. 3 and 4, the side extensions 68 free up the center space of the deck 14 for the user's feet. The side extensions 68 allow the rear support points to be farther out creating a more stable platform for the user. The deck 14 as an example may be 23-inch-wide 30-inch-long with two 10-inch-long 3-inch-wide extensions about four inches from the back. The frame of the deck 14 can be constructed out of ½ or ¾ inch square tubing and covered with a lightweight plastic or wood material.

Multiple channels 72 and 76 in the back of the platform enable the deck 14 to sit close to the shaft 28 on the lifting gear assembly 16, which enables the workout machine 12 to be lower, which makes it more compact and safer to operate. The channels 72 and 76 also allow the deck 14 to start out with a gradual slope and pivot to a flat position at the apex of lifts.

The preferred deck 14 has multiple channels 72 and 76 in the back third of the base 24: two of the channels 72 can each be in the 3"×10" side extensions 68 on the base 24 and another channel 76 can be in the center of the base 24. The channels 72 in the side extensions 68 of the base 24 allow room for the function of the two spiral lifting mechanisms 18. (By offsetting the spiral lifting mechanisms, the deck 14 of the workout machine 12 is unobstructed for the user's stance on the machine.) The channel 76 in the rear center of the base 24 accommodates the graduated spooling mechanism 26. The channels 72 and 76 allow the deck 14 to attach close to the shaft 28 of the spiral lifting mechanism 18, which lowers the overall profile of the workout machine 12. The lower profile makes the workout machine 12 more compact and more stable for the user.

The deck 14 preferably also has a channel 34 in the center front of the deck 14 to allow the cable 20 to travel through the deck 14 and then rotate around the pulley 22 mounted to the underside of the deck 14.

The preferred deck 14 further has a channel 78 in the front of the workout machine 12 toward the back of the machine, such as approximately four inches from the right side of the deck 14. The channel 78 allows for the functioning of the user location pivot arm assembly 80 as detailed below.

The pivot arm assembly 80 includes user location pivot arm 84 in conjunction with a screen stand 86 with a pivotally attached screen platform 88. An attachment means 82, such as a bracket and pin, attaches the user location pivot arm 84 to the bottom of the deck 14. A compression spring 90 may be used with the user location pivot arm 84, on the distal end from the attachment means 82.

The user location pivot arm 84 extends from the workout machine 12. The user location pivot arm 84 can be bolted to the bottom of the deck 14 via a pin and mounting bracket, at the back of a channel 78. The user location pivot arm 84 ideally extends substantially vertically from the deck 14 of the workout machine 12 and attaches to a screen platform 88, from which can pivot via a preferred pivot joint. The vertical extension can be designed to fold/detach/or telescope for transport and storage. Under the front of the pivot arm assembly 80 can be a compression spring 90, such as mounted to a bracket via a through bolt. The user location pivot arm 84 is instrumental in enabling the workout machine 12 to interface with the interactive/social app.

For a complementary app to function, two key data items are gathered from the workout machine 12: user location and number of lifts that the user performed. In conjunction with the screen stand 86 mounted to the deck 14, the app can use one of the built-in accelerometers in a smart device to detect when the deck 14 moves to count the number of lifts that the user has performed.

A unique fulcrum design of the workout machine 12 utilizes the concept of a fulcrum and a lever. As the user stands closer to the front of the deck 14, the user is effectively creating a longer lever relative to the fulcrum and the resistance needed to lift the platform that the user is standing on is reduced. As the user moves her feet to the back of the workout machine 12, the user is effectively creating a shorter lever relative to the fulcrum and the resistance is greater.

When the user stands at the back of the workout machine 12, the user location pivot arm 84 is only slightly compressed. As the user shifts her feet forward on the workout machine 12, the user location pivot arm 84 is gradually compressed. As the user location pivot arm 84 is compressed, the vertical extension of the user location pivot arm 84, causes the screen platform 88 to rotate vertically.

One of the smart device's accelerometers can detect the slight movements caused by the user location pivot arm's effect on the screen platform 88 and uses this information via an algorithm coded into the app to gauge the exact location of the user's position relative to the deck 14.

The unique algorithmic aspect of the disclosed fulcrum geometry combined with the user location feature allows an app to calculate the percent of the users' body weight the user is lifting with each repetition.

When the user first installed the preferred app, one of the data items entered was the user's weight to assist with calculations. There are effectively endless resistance levels for the workout machine 12.

The user does not need to leave the workout machine 12 or adjust/add any weights/parts of the workout machine 12 to change the resistance of the exercise. The app captures and counts each rep and measures the resistance used for each rep.

Data gathered from these two sensors are incorporated into the database of the app that allows for extensive workout analysis.

Regarding the screen platform 88, the user can set her smart device, such as a phone, pad or tablet, on the screen platform 88 and secure it with clips or simply have the lip of the screen platform 88 to hold it in place. A preferred right side of the screen platform 88 can be mounted to the end of the screen stand 86 utilizing a simple bolt that forms a pivot joint allowing the platform to rotate up and down. The user location pivot arm 84 can attach to the left side of the screen platform 88 with a bolt that forms a pivot joint allowing the screen platform 88 to rotate up and down.

The preferred screen stand 86 mounts to the front of the deck 14 and extends vertically at an angle. The upper end of the screen stand 86 attaches to the screen platform 88. The screen stand 86 can be designed to fold, detach, or telescope for transportation and storage.

While the workout machine 12 can have integrated electronics, the preferred design incorporates apps and technology from existing smart devices, such as smart phones and pad devices. An interactive app can enhance the interactive/social aspect of the workout machine 12.

Downloadable Smart Device/Tablet App

An app can use internet connectivity, user input and data gathered via accelerometer readings to create a machine/user/social community interactive experience. Utilizing the user's own smart device enables the workout machine 12 to be a "smart" machine without the need of incorporating expensive electronics into the physical design.

The physical workout machine 12 combined with an app can track multiple aspects of the user's workout routine with minimal or no data input from user. Benefits of a preferred app can allow the user to:

- workout with friends via the integrated camera of the phone or tablet;
- participate in a live or pre-recorded workout class (with a preferred free app and potential for recurring subscription revenue for classes);
- participate in or start workout challenges; and
- graph, tabulate workout date to track progress and goals.

The user not needing to leave or adjust the workout machine 12 over the course of an entire workout results in the captive, uninterrupted attention of users, creating a media content aspect to the app including web connectivity ideal for a touch ad to generate additional revenue.

The social/internet connectivity helps to keep the user engaged in her workout programs. For example: video feature enables users to work out to live classes, to work out to pre-recorded classes, to work out with friends/coaches, or to watch videos on proper lifting technique. A challenge feature could be designed to create fun challenges, wherein a user can challenge a friend to an end result, such as first to lift 10,000 total pounds or first to perform 1,000 reps. Similarly, groups can be formed to engage in challenges, such as team challenges.

Data gathered from accelerometers can measure and enable the app to track, graph, store, and share numerous aspects of a user's current and past workouts. For example, the app can assign number of reps and weight of each specific exercise to a database, calculate the total/average weight lifted for each exercise, can calculate the total/average number of reps for each exercise, can calculate the total weight lifted during a full workout or can graph various results of a workout. Also, the app can give results for a day, week, month, or year, or since inception for all workouts performed.

Due to the fact that the user does not need to leave the workout machine 12 or adjust it during a workout results in the user being engaged with the smart device over the entire length of the workout, the electronic device can be a media source, including for content and ads.

The Function and Operation of the Workout Machine

The User preferably sets the workout machine 12 on a flat solid surface, unfolds the upright user location pivot arm 84 and the screen stand 86. The physical machine aspect of the combined machine is now ready for use.

At some point, the user downloads the preferred app to a smart device, phone or tablet and starts the app. First time users would be asked to enter a few pieces of data, such as weight.

The user places a smart device/phone/tablet with the preferred app in an integrated holder, such as the screen platform 88, on the workout machine 12.

At this point, the integration of the physical machine and app are complete, and the user is ready to start her new interactive workout experience.

The user navigates the easy-to-follow guide/dropdown menu on the app start screen, such as:

a. Chose an exercise
b. Solo workout/pre-recorded video workout/live workout/facetime workout with trainer or friend
c. Rep counter/weight per rep counter/total counter.
d. Graphics/history
e. Challenges
f. Pop-up adds The user steps on the deck 14 and preferably utilizes the cable spooling and tie off assembly of the lifting handle 30 to adjust the length of the cable 20 to the proper length of the exercise she has chosen.

The resistance adjustment is an exceptional aspect. A unique feature of the workout machine 12 relies on the concept of a fulcrum and a lever. As the user stands closer to the front of the workout machine 12, she is effectively creating a longer lever relative to the fulcrum and the resistance needed to lift the platform the user is standing on is reused. As the user moves her feet to the back of the workout machine 12, the user is effectively creating a shorter lever relative to the fulcrum and the resistance is greater.

Further, in operation, when the user stands at the back of the workout machine 12, the user location pivot arm 84 is only slightly compressed. As the user shifts her feet forward on the workout machine 12, the user location pivot arm 84 is gradually compressed. As the user location pivot arm 84 is compressed, the vertical extension of the pivot location arm 84, causes the screen platform 88 to rotate vertically. The app, as downloaded on a smart device, utilizes one of the device's three accelerometers built into the smart device to measure this change. An accelerometer allows for a precise measurement of the user's location on the workout machine 12.

The user may perform one test rep of the exercise that she has chosen to test the resistance level. If the resistance is too high, the user simply adjusts her feet forward on the workout machine 12 to lower the resistance, if the resistance is to light, the user adjusts her feet backwards on the workout machine 12 to increase the resistance. When proper resistance is obtained, the user performs the full set of lifts for the exercise she has chosen.

The app utilizes the built-in accelerometer sensors of a smart device to gather two critical pieces of data. First, one of the smart device's built-in accelerometers detects when the platform of the workout machine 12 moves. The data gathered from movement is used to count the number of reps the user performs. Second, another of the smart device's built-in accelerometers is used to track the user's position on the workout machine 12.

The smart device's accelerometer can detect the slight movements caused by the user location pivot arm 84 and use this information via an algorithm coded into the app to gauge the exact location of the user's position on the deck 14. When the user first installed the preferred app, one of the information items entered was the user's weight.

The unique algorithmic aspect of the fulcrum geometry combined with the user location feature allow the integrated machine to calculate the percent of the user's body weight the user is lifting with each repetition. There are effectively endless resistance levels for the workout machine 12. The user does not need to leave the workout machine 12 or adjust/add any weights/parts of the workout machine 12 to change the resistance of the exercise. The app captures and counts each rep and measures the resistance used for each rep.

Data gathered from these two or three sensors are incorporated into the database of the app, which allows for extensive workout analysis.

The ideal workout machine 12 enables users to perform multiple traditional weight lifting exercises, track and store data from their workouts, and interact with the outside world via an integrated social media app.

This disclosure has been described as having exemplary embodiments and is intended to cover any variations, uses, or adaptations using its general principles. It is envisioned that those skilled in the art may devise various modifications and equivalents without departing from the spirit and scope of the disclosure as recited in the claims. Further, this disclosure is intended to cover such variations from the present disclosure as come within the known or customary practice within the art to which it pertains.

What is claimed is:

1. A workout machine adapted to be used with a smart device with built-in accelerometers that can detect movement of parts of the workout machine and a complementary app that can use data generated by the accelerometers, the workout machine including:

a base;

a deck pivotable relative to the base;

a lifting handle adapted to adjust a length of a cable by winding the cable around the lifting handle; the lifting handle attached to the cable, the cable redirected via a pulley on the underside of the deck to a lifting gear assembly mounted on an underside of the deck, the lifting gear assembly includes a spiral lifting mechanism and a graduated spooling mechanism centered on a shaft, the spiral lifting mechanism having a logarithmic groove;

a cam follower fixed on the base wherein the cam follower is inserted in the logarithmic groove, wherein the spiral lifting mechanism and the cam follower interact to raise the deck as the user pulls on the lifting handle;

the deck raises a distance equal to a distance between a center most groove point of the spiral lifting mechanism to an outer most groove point of the spiral lifting mechanism resulting in a user lifting a percentage of her own bodyweight; and a user location pivot arm fixed to the deck and a screen stand extending substantially vertically from the deck, the user location pivot arm and the screen stand pivotably attached to a screen platform adapted to hold the smart device, wherein the smart device can interface with information from movement of the screen stand via the user location pivot arm, wherein the user's position on the deck affects resistance of the exercise based on a percentage of lifting the user's own bodyweight that the user is lifting as the deck moves upwards when the user pulls on the lifting handle which operates the lifting gear assembly, and as the user moves forward and backward on the deck, the user location pivot arm causes the screen stand to move, which can be detected by the accelerometers in the smart device.

2. The workout machine of claim 1 wherein the deck includes side extensions on each side to increase surface area available for the user to stand on and perform exercises on a center of the deck and to accommodate the spiral lifting mechanism on each side of the deck.

3. The workout machine of claim 1 wherein the deck includes multiple channels for passage for the cable, the spiral lifting mechanism, the graduated spooling mechanism and the user location pivot arm to form a compact profile.

4. The workout machine of claim 1 in combination with the smart device wherein the app of the smart device uses one of the built-in accelerometers in the smart device to detect when the deck moves to count the number of lifts that the user has performed.

5. The workout machine of claim 1 wherein the user location pivot arm consists of a lower bar and an upper bar attached at a pivot point wherein the lower bar extends from the deck at an angle and wherein the upper arm is attached to the screen stand so as the lower bar is compressed, the upper bar arm causes the screen stand to rotate down so that the accelerometers of the smart device set on the screen stand can detect such rotation down and feeds corresponding data into the app of the smart device.

* * * * *